US011764528B2

(12) United States Patent
Anderson

(10) Patent No.: US 11,764,528 B2
(45) Date of Patent: Sep. 19, 2023

(54) CHARGER OUTLET COVER ASSEMBLY

(71) Applicant: David Anderson, Temecula, CA (US)

(72) Inventor: David Anderson, Temecula, CA (US)

( * ) Notice: Subject to any disclaimer, the term of this patent is extended or adjusted under 35 U.S.C. 154(b) by 40 days.

(21) Appl. No.: 17/507,987

(22) Filed: Oct. 22, 2021

(65) Prior Publication Data

US 2023/0127590 A1 Apr. 27, 2023

(51) Int. Cl.

| | |
|---|---|
| ***H01R 25/00*** | (2006.01) |
| ***H01R 24/76*** | (2011.01) |
| ***H01R 13/72*** | (2006.01) |
| ***H01R 24/60*** | (2011.01) |
| ***H01R 13/66*** | (2006.01) |

(52) U.S. Cl.

CPC ..... *H01R 25/006* (2013.01); *H01R 13/6675* (2013.01); *H01R 13/72* (2013.01); *H01R 24/60* (2013.01); *H01R 24/76* (2013.01)

(58) Field of Classification Search

CPC .. H01R 25/006; H01R 13/6675; H01R 13/72; H01R 24/60; H01R 24/76

USPC ..... 439/535

See application file for complete search history.

(56) References Cited

U.S. PATENT DOCUMENTS

| | | | | |
|---|---|---|---|---|
| 8,384,241 | B2 * | 2/2013 | Chen | H01R 31/065 307/11 |
| 8,696,368 | B2 * | 4/2014 | Quezada | H01R 25/006 439/108 |
| 8,712,486 | B2 * | 4/2014 | Sorias | H02J 7/0044 439/131 |
| 8,794,997 | B2 | 8/2014 | Tin | |
| 9,495,375 | B2 * | 11/2016 | Huang | H04M 1/72409 |
| 9,544,005 | B2 * | 1/2017 | Wei | H02J 7/0048 |
| 9,893,543 | B2 * | 2/2018 | Miller | H02J 7/0042 |
| 9,965,007 | B2 * | 5/2018 | Amelio | G06F 1/1632 |
| 9,977,462 | B2 * | 5/2018 | Sorias | G06F 1/1632 |
| 10,461,484 | B2 | 10/2019 | Murahari | |
| 10,700,482 | B1 | 6/2020 | Vela | |
| D948,445 | S * | 4/2022 | Helms | D13/137.3 |
| 2002/0022390 | A1 * | 2/2002 | Duerbaum | H01R 24/68 439/130 |
| 2008/0012423 | A1 | 1/2008 | Mimran | |
| 2013/0193911 | A1 * | 8/2013 | Miller | H02J 7/0049 320/107 |
| 2014/0192481 | A1 * | 7/2014 | Wojcik | G06F 21/86 361/679.55 |
| 2014/0253038 | A1 * | 9/2014 | Posa | H02J 5/00 320/111 |
| 2014/0270234 | A1 * | 9/2014 | Beal | H04R 1/1025 381/74 |

(Continued)

FOREIGN PATENT DOCUMENTS

| | | |
|---|---|---|
| CA | 3011680 | 1/2019 |

*Primary Examiner* — Alexander Gilman

(57) ABSTRACT

A charger outlet cover assembly for charging electronic devices includes a wall plate that is positionable over a female electrical outlet. A plurality of contacts is each of the contacts is coupled to the wall plate thereby facilitating each of the contacts to engage a respective socket in the female electrical outlet. A pair of chargers is each coupled to the wall plate. Each of the chargers is in electrical communication with respective ones of the contacts to receive electrical power from a power source. A pair of charging cords is each retractably disposed on a respective one of the chargers to charge a respective electronic device.

4 Claims, 5 Drawing Sheets

(56) References Cited

U.S. PATENT DOCUMENTS

| | | | | |
|---|---|---|---|---|
| 2015/0129722 | A1* | 5/2015 | Green | H02J 7/0044 248/51 |
| 2020/0366036 | A1 | 11/2020 | Candella | |
| 2021/0210915 | A1* | 7/2021 | Galazin | H01R 13/6691 |

* cited by examiner

CHARGER OUTLET COVER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to outlet cover devices and more particularly pertains to a new outlet cover device for charging electronic devices. The device includes a wall plate and a plurality of contacts that are attached to the wall plate. The wall plate is positionable on a female electrical outlet such that each of the contacts is plugged into the female electrical outlet. The device includes a pair of chargers that is each attached to the wall plate and a pair of charging cords that are retractably integrated into a respective charger.

(2) Description of Related Art Including Information Disclosed Under 37 CFR 1.97 and 1.98

The prior art relates to outlet cover devices including a variety of modular electrical outlets for converting alternating current into direct current. The prior art discloses a variety of electrical outlets that have charging ports integrated therein for charging electronic devices. The prior art discloses an electrical outlet that includes a variety of charging ports and a charging cable that is retractably integrated into the electrical outlet.

BRIEF SUMMARY OF THE INVENTION

An embodiment of the disclosure meets the needs presented above by generally comprising a wall plate that is positionable over a female electrical outlet. A plurality of contacts is each of the contacts is coupled to the wall plate thereby facilitating each of the contacts to engage a respective socket in the female electrical outlet. A pair of chargers is each coupled to the wall plate. Each of the chargers is in electrical communication with respective ones of the contacts to receive electrical power from a power source. A pair of charging cords is each retractably disposed on a respective one of the chargers to charge a respective electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
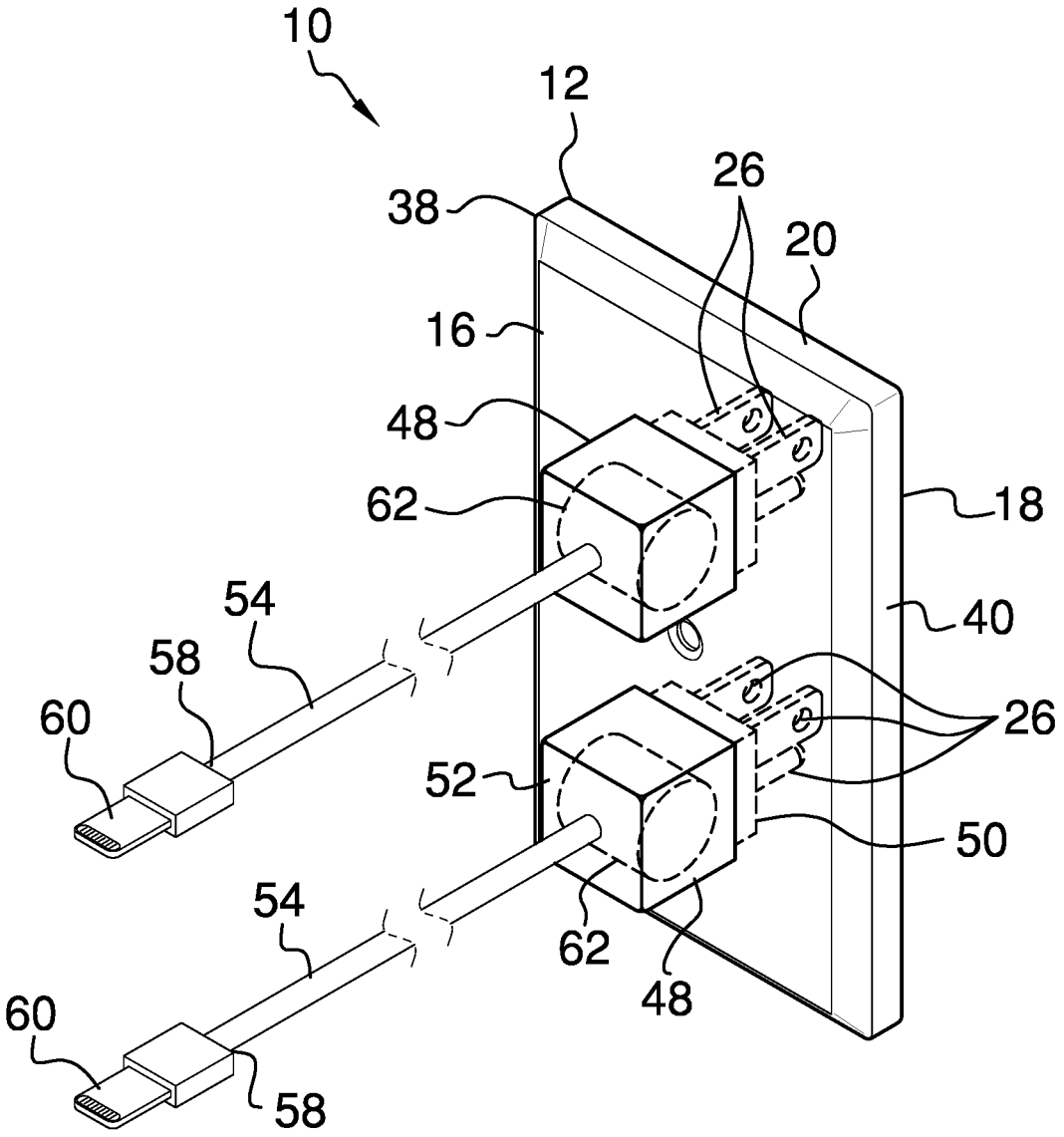
FIG. 1 is a perspective phantom view of a charger outlet cover assembly according to an embodiment of the disclosure.
Figure 2:
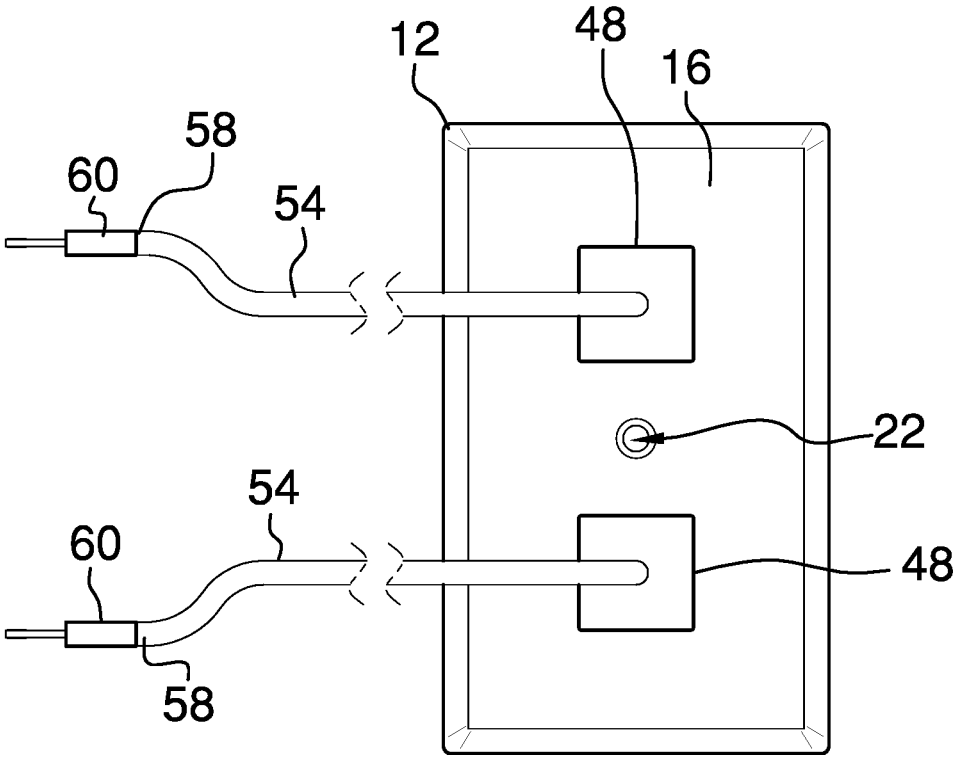
FIG. 2 is a front view of an embodiment of the disclosure.
Figure 3:
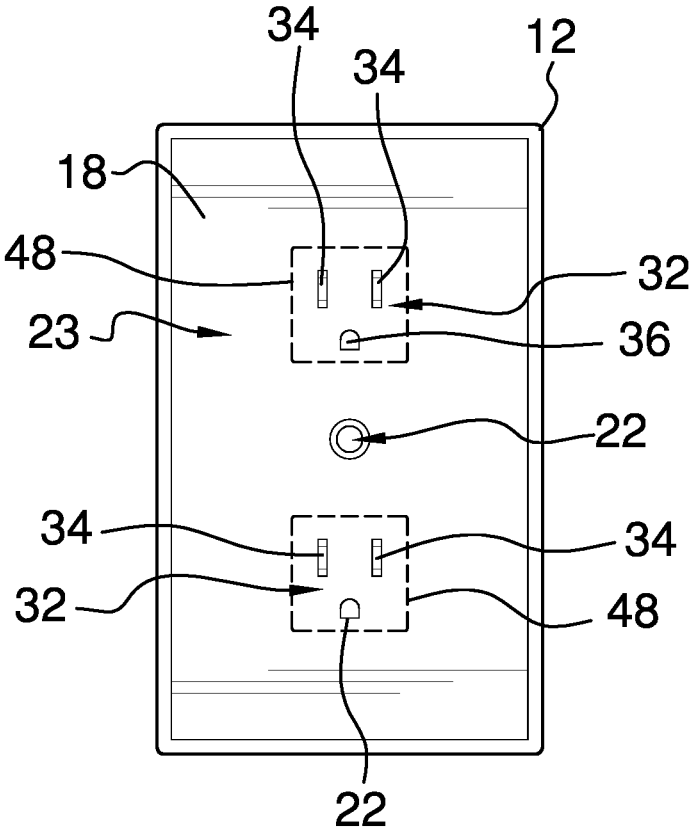
FIG. 3 is a back view of an embodiment of the disclosure.
Figure 4:
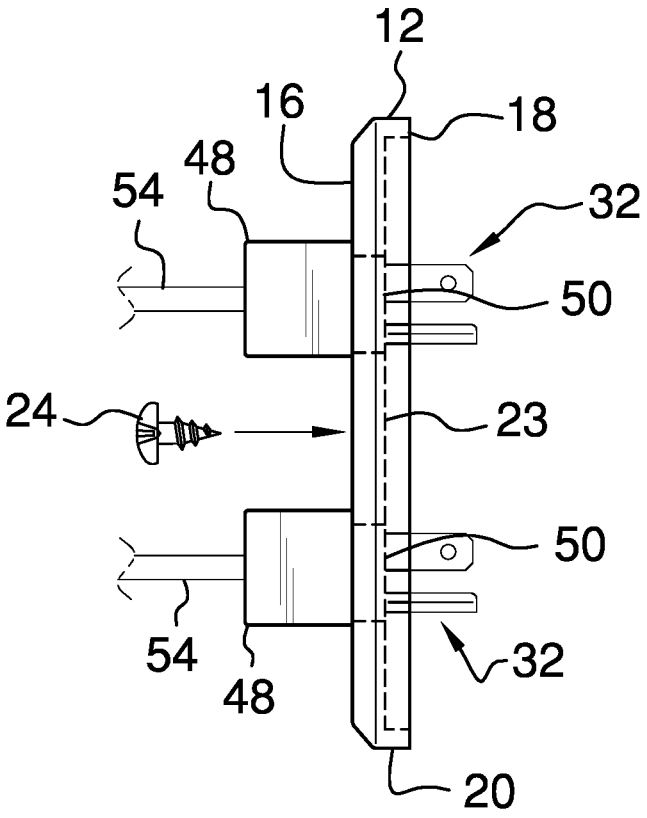
FIG. 4 is a left side phantom view of an embodiment of the disclosure.
Figure 5:
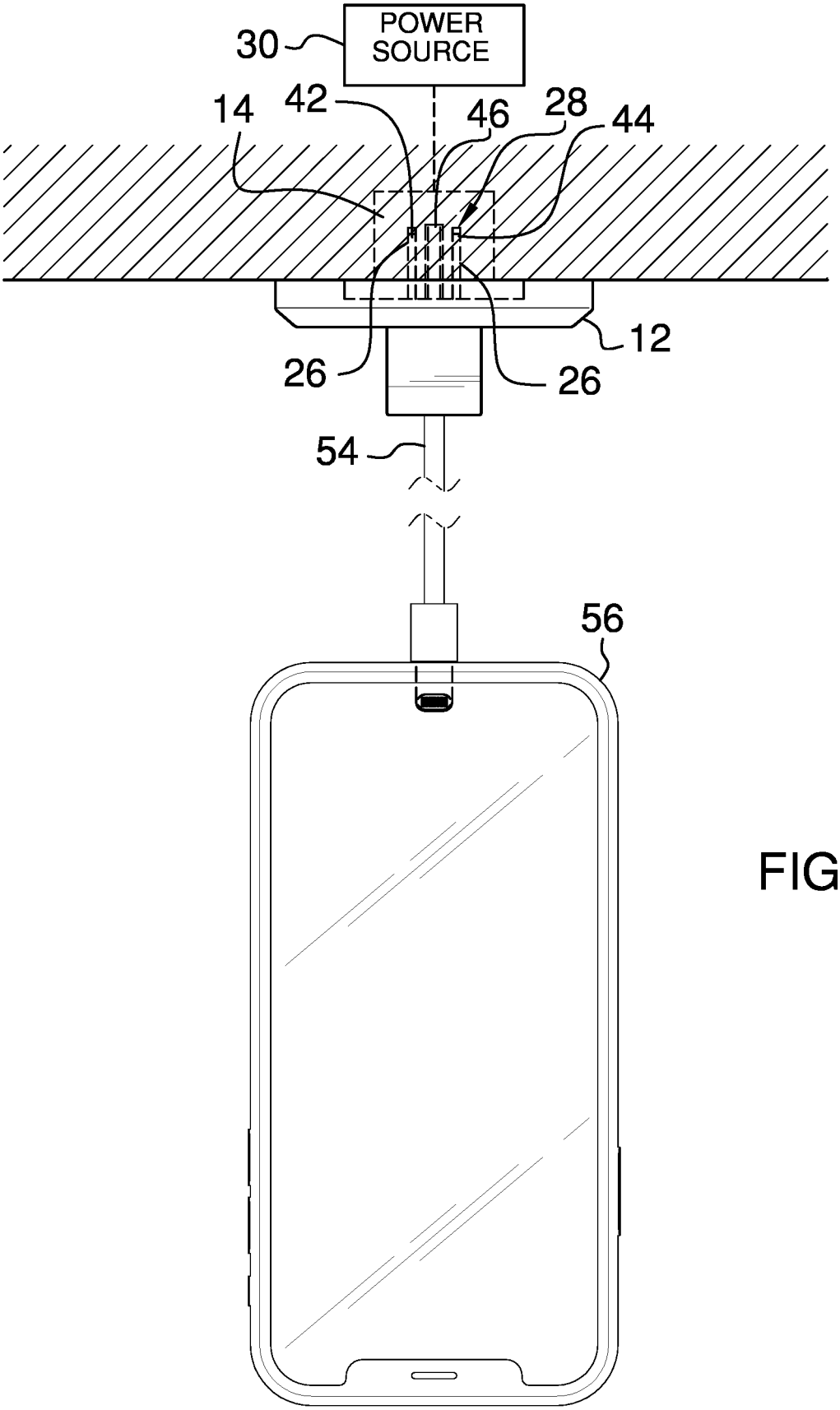
FIG. 5 is a perspective in-use view of an embodiment of the disclosure.

With reference now to the drawings, and in particular to FIGS. 1 through 5 thereof, a new outlet cover device embodying the principles and concepts of an embodiment of the disclosure and generally designated by the reference numeral 10 will be described.

As best illustrated in FIGS. 1 through 5, the charger outlet cover assembly 10 generally comprises a wall plate 12 that is positionable over a female electrical outlet 14. The female electrical outlet 14 may be an electrical outlet in a wall of a building, such as a home, an office building or any other structure that would commonly be occupied. The wall plate 12 has a front side 16, a back side 18 and a perimeter edge 20 extending between the front side 16 and the back side 18. The wall plate 12 may have a thickness of at least 0.25 inches and a length and height that correspond to traditional wall plates for electrical outlets. The wall plate 12 has a fastener hole 22 extending through the front side 16 and the back side 18 to accommodate a fastener 24 which engages the female electrical outlet 14, and the fastener hole 22 is centrally positioned on the wall plate 12. As is most clearly shown in FIG. 4, the back side 18 may have a recess 23 extending toward the front side 16 which accommodates the female electrical outlet 14. Additionally, the perimeter edge 20 may have an angled portion 25 that tapers inwardly to intersect with the front side 16 of the wall plate 12.

A plurality of contacts 26 is each coupled to the wall plate 12 thereby facilitating each of the contacts 26 to engage a respective socket 28 in the female electrical outlet 14. In this way the plurality of contacts 26 is in electrical communication with a power source 30 supplying electrical power to the female electrical outlet 14. The power source 30 may comprise an electrical system of the building in which the female electrical outlet 14 is positioned. Additionally, each of the contacts 26 is comprised of an electrically conductive material.

Each of the contacts 26 extends away from the back side 18 of the wall plate 12 and the plurality of contacts 26 includes a pair of sets of contacts 32. Each of the pair of sets of contacts 32 includes a pair of flattened contacts 34 and a rounded contact 36. Each of the flattened contacts 34 associated with each of the sets of contacts 32 is spaced apart from each other and the flattened contacts 34 lie on an axis extending between a first lateral side 38 and a second lateral side 40 of the perimeter edge 20 of the wall plate 12. The rounded contact 36 associated with a respective one of the sets of contacts 32 is positioned below the pair of flattened contacts 34 associated with the respective set of contacts 26. Furthermore, the rounded contact 36 associated with a respective one of the sets of contacts 32 is centrally positioned between the pair of flattened contacts 34 associated with the respective set of contacts 26. Each of flattened contacts 34 engages a respective hot contact 42 and neutral contact 44 of the respective socket 28 and the rounded contact 36 engages a ground contact 46 of the respective socket 28.

A pair of chargers 48 is provided and each of the chargers 48 is coupled to the wall plate 12. Each of the chargers 48 is in electrical communication with respective ones of the contacts 26 to receive electrical power from the power source 30. Each of the chargers 48 has a rear side 50 and a front side 52, and each of the chargers 48 is recessed into the front side 52 of the wall plate 12 such that the rear side 50 of each of the chargers 48 is positioned within the wall plate 12. Furthermore, each of the sets of contacts 32 is coupled to the rear side 50 of a respective one of the chargers 48. Each of the chargers 48 may include electronic circuitry that is common to smart phone chargers, for example, or other chargers that convert alternating current into direct current.

A pair of charging cords 54 is provided and each of the charging cords 54 is retractably disposed on a respective one of the chargers 48. In this way each of the charging cords 54 can be electrically coupled to a respective electronic device 56 to charge the respective electronic device 56. The electronic device 56 may be a smart phone or other similar type of personal electronic device 56. Each of the charging cords 54 extends away from the front side 52 of the respective charger 48 and each of the charging cords 54 has a distal end 58 with respect to the front side 16 of the respective charger 48. The distal end 58 of each of the charging cords 54 has an electrical plug 60 electrically coupled to the distal end 58. In this way the electrical plug 60 on each of the charging cords 54 can electrically engage the respective electronic device 56. The electrical plug 60 on each of the charging cords 54 may comprise a charge plug for an Android device, a charge plug for an Apple® device or any other common charging plug.

A pair of retractors 62 is provided and each of the retractors 62 is integrated into a respective one of the chargers 48. Each of the retractors 62 is in communication with the charging cord 54 on the respective charger 48. Each of the retractors 62 is biased to retract the respective charging cord 54 into the respective charger 48 for storage. Conversely, each of the retractors 62 is actuatable to release the respective charging cord 54 outwardly from the respective charger 48 for employing the respective charging cord 54 for charging the electronic device 56. Each of the retractors 62 might include a spool around which the respect charging cord 54 is wrapped. Moreover, the spool might be biased to rotate in a first direction for retracting the charging cord 54 and the spool may be urgeable to rotate in a second direction for pulling the charging cord 54 outwardly from the respective charger 48.

In use, the wall plate 12 is positioned on the female outlet 14 such that each of the contacts 26 is plugged into the respective female electrical outlet 14 and a fastener 24 is extended through the fastener hole 22 to engage the female electrical outlet 14. A respective one of the charging cords 54 is pulled outwardly from the respective charger 48 and the respective charging cord 54 is plugged into the electronic device 56 to charge the electronic device 56. The pair of chargers 48 integrated into the wall plate 12 ensures that chargers 48 are always available and not subject to being misplaced. In this way a charger is always available to charge the electronic devices 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A charger outlet cover assembly having phone chargers integrated into a wall plate for inhibiting the phone chargers from becoming misplaced, said assembly comprising:

a wall plate being positionable over a female electrical outlet;

a plurality of contacts, each of said contacts being coupled to said wall plate thereby facilitating each of said contacts to engage a respective socket in the female electrical outlet wherein said plurality of contacts is configured to be in electrical communication with a power source supplying electrical power to the female electrical outlet;

a pair of chargers, each of said chargers being coupled to said wall plate, each of said chargers being in electrical communication with respective ones of said contacts wherein each of said chargers is configured to receive electrical power from the power source;

a pair of charging cords, each of said charging cords being retractably disposed on a respective one of said chargers wherein each of said charge cords is configured to be electrically coupled to a respective electronic device to charge the respective electronic device;

wherein said wall plate has a front side, a back side and a perimeter edge extending between said front side and said back side;

wherein each of said contacts extends away from said back side of said wall plate, said plurality of contacts including a pair of sets of contacts, each of said pair of sets of contacts including a pair of flattened contacts and a rounded contact, each of said flattened contacts associated with each of said sets of contacts being spaced apart from each other, said rounded contact associated with a respective one of said sets of contacts being positioned below said pair of flattened contacts associated with said respective set of contacts, said rounded contact associated with a respective one of said sets of contacts being centrally positioned between said pair of flattened contacts associated with said respective set of contacts; and wherein each of said chargers has a rear side and a front side, each of said chargers being recessed into said front side of said wall plate such that said rear side of each of said chargers is positioned within said wall plate, each of said sets of contacts being coupled to said rear side of a respective one of said chargers.

2. The assembly according to claim 1, wherein each of said charging cords extends away from said front side of said respective charger, each of said charging cords having a distal end with respect to said front side of said respective charger, said distal end of each of said charging cords having an electrical plug being electrically coupled thereto wherein said electrical plug on each of said charging cords is configured to electrically engage the respective electronic device.

3. The assembly according to claim 1, further comprising a pair of retractors, each of said retractors being integrated into a respective one of said chargers, each of said retractors being in communication with said charging cord on said respective charger, each of said retractors being biased to retract said respective charging cord into said respective charger for storage, each of said retractors being actuatable to release said respective charging cord outwardly from said respective charger for employing said respective charging cord for charging the electronic device.

4. A charger outlet cover assembly having phone chargers integrated into a wall plate for inhibiting the phone chargers from becoming misplaced, said assembly comprising:

a wall plate being positionable over a female electrical outlet, said wall plate having a front side, a back side and a perimeter edge extending between said front side and said back side;

a plurality of contacts, each of said contacts being coupled to said wall plate thereby facilitating each of said contacts to engage a respective socket in the female electrical outlet wherein said plurality of contacts is configured to be in electrical communication with a power source supplying electrical power to the female electrical outlet, each of said contacts extending away from said back side of said wall plate, said plurality of contacts including a pair of sets of contacts, each of said pair of sets of contacts including a pair of flattened contacts and a rounded contact, each of said flattened contacts associated with each of said sets of contacts being spaced apart from each other, said rounded contact associated with a respective one of said sets of contacts being positioned below said pair of flattened contacts associated with said respective set of contacts, said rounded contact associated with a respective one of said sets of contacts being centrally positioned between said pair of flattened contacts associated with said respective set of contacts;

a pair of chargers, each of said chargers being coupled to said wall plate, each of said chargers being in electrical communication with respective ones of said contacts wherein each of said chargers is configured to receive electrical power from the power source, each of said chargers having a rear side and a front side, each of said chargers being recessed into said front side of said wall plate such that said rear side of each of said chargers is positioned within said wall plate, each of said sets of contacts being coupled to said rear side of a respective one of said chargers;

a pair of charging cords, each of said charging cords being retractably disposed on a respective one of said chargers wherein each of said charge cords is configured to be electrically coupled to a respective electronic device to charge the respective electronic device, each of said charging cords extending away from said front side of said respective charger, each of said charging cords having a distal end with respect to said front side of said respective charger, said distal end of each of said charging cords having an electrical plug being electrically coupled thereto wherein said electrical plug on each of said charging cords is configured to electrically engage the respective electronic device; and a pair of retractors, each of said retractors being integrated into a respective one of said chargers, each of said retractors being in communication with said charging cord on said respective charger, each of said retractors being biased to retract said respective charging cord into said respective charger for storage, each of said retractors being actuatable to release said respective charging cord outwardly from said respective charger for employing said respective charging cord for charging the electronic device.

* * * * *